United States Patent [19]

Berlese

[11] Patent Number: 4,570,269

[45] Date of Patent: Feb. 18, 1986

[54] RACING GLOVE

[76] Inventor: Remo Berlese, 31036 Via Ospedaletto Di Istrana (TV), Via Castellana Z.I., Italy

[21] Appl. No.: 675,814

[22] Filed: Nov. 12, 1984

[51] Int. Cl.[4] ..... A41D 19/00

[52] U.S. Cl. ..... 2/161 A; 2/20; 2/DIG. 1

[58] Field of Search ..... 2/161 A, 161 R, 159, 2/16, 20, 22, 425, DIG. 1

[56] References Cited

U.S. PATENT DOCUMENTS

| | | | |
|---|---|---|---|
| 2,907,047 | 10/1959 | Steinberg | 2/161 A |
| 3,296,626 | 1/1967 | Ludwikowski | 2/DIG. 1 |
| 4,411,024 | 10/1983 | Hayes | 2/20 |

FOREIGN PATENT DOCUMENTS

| | | | |
|---|---|---|---|
| 525962 | 5/1955 | Italy | 2/DIG. 1 |
| 2104770 | 3/1983 | United Kingdom | 2/DIG. 1 |

OTHER PUBLICATIONS

1984 AXO Catalog, AXO s.n.c., pp. 18 and 19.

*Primary Examiner*—Werner H. Schroeder
*Assistant Examiner*—J. L. Olds
*Attorney, Agent, or Firm*—Koppel & Harris

[57] ABSTRACT

A vented racing glove suitable for motorcycle use in which a flexible protective pad is attached over the top of the gloove. The pad has various integrally formed upstanding air scoops which receive air when the glove is in motion to provide positive ventilation to its interior, and protect the wearer's hand in case of a fall. Ventilation grills are also provided in the pad in the form of parallel upstanding ribs with vent openings in the pad between adjacent ribs. The grills likewise provide both ventilation and protection. The fingers of the pad include forward facing air scoops behind the finger joints and rearward facing air scoops forward of the finger joints, with the air inlets of both scoops facing forward when the wearer grips a motorcycle hand grip.

21 Claims, 4 Drawing Figures

Fig.1.
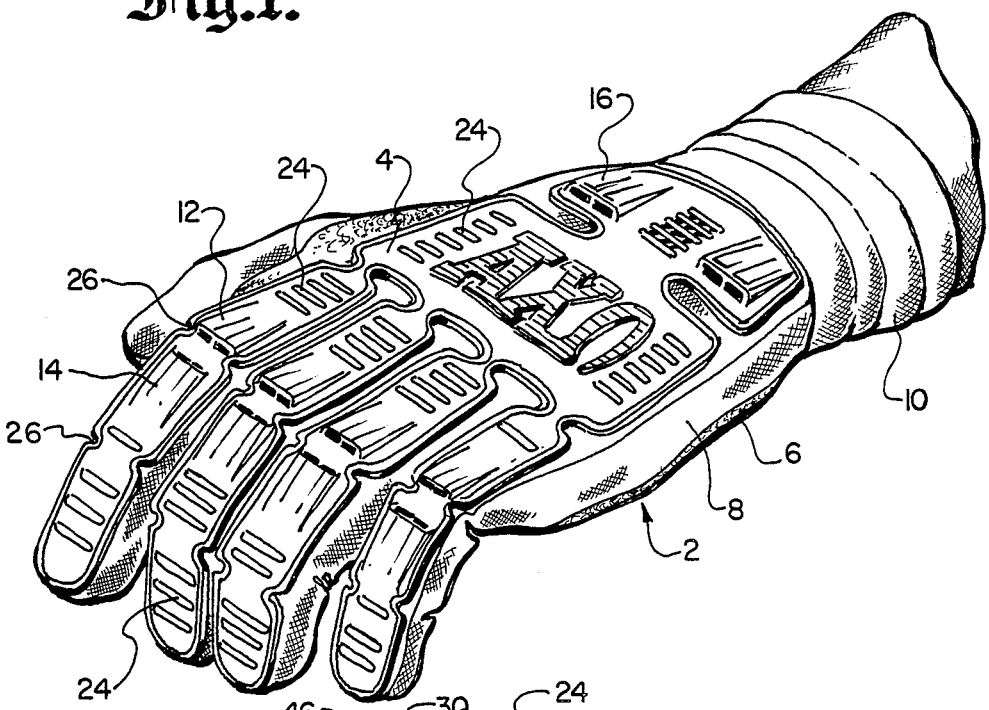
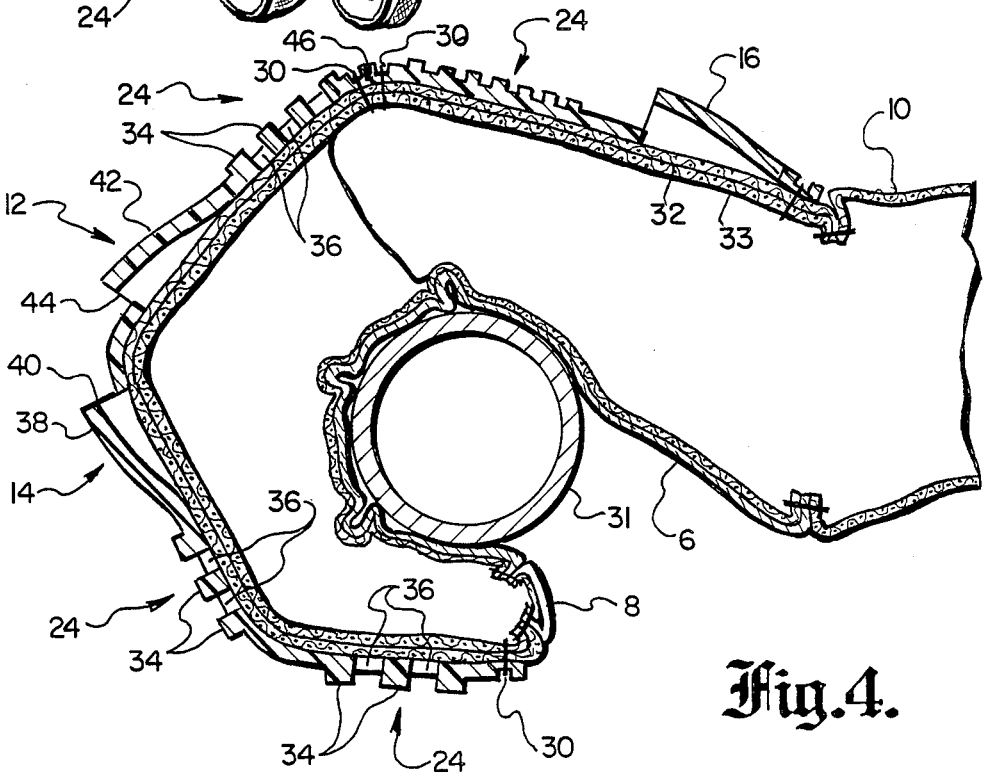
Fig.4.

RACING GLOVE

BACKGROUND OF THE INVENTION

1. Field of the Invention

This invention relates to sportswear, and more particularly to protective gloves for motorcycle racing.

2. Description of the Prior Art

Gloves for motorcycle racing and other high speed sports have had two major problems: (1) the insides of the gloves can become quite hot and uncomfortable in the warm temperatures typical of motorcycle racing, and (2) they do not provide enough protection against injuring the hands in a fall from the motorcycle or similar accident.

In the past, the upper sides of some gloves have been formed from an open weave material to provide greater ventilation. While this has reduced the heating problem somewhat, the insides of the gloves can still become uncomfortably warm when the weather is hot. Furthermore, the open weave material does not provide a great deal of protection against scrapes and injuries to the hands.

In one attempt to produce a safer glove, a pad of protective plastic material has been sewn over the back of the glove. The pad includes finger sections which extend over the glove fingers, and a broader section which covers the back of the hand. While such protective pads can reduce scrapes and abrasions when the rider falls from his or her motorcycle, they tend to make the heating problem worse. Additionally, the pads can make it more difficult to flex the glove, and thereby contribute to both wearer discomfort and an inability to grasp the handlebars with as sure a grip as without the pads.

SUMMARY OF THE INVENTION

In view of the above problems associated with the prior art, it is an object of this invention to provide a novel and improved glove for motorcycle racing and similar sports which affords a high degree of protection against scrapes and bruises to the hand, and at the same time is highly flexible and includes a positive ventilation system which provides greater cooling to the interior of the glove than has been available with prior gloves, both padded and unpadded.

In the accomplishment of these and other objects of the invention, a racing glove is provided with a outer pad of flexible protective material which is attached to and overlies the upper side of an inner glove. A plurality of air vents are formed in the protective pad for receiving air when the glove is in motion, and thereby cool the interior of the glove. The glove may be either open under the protective pad so that outside air flows directly to the wearer's skin, or a layer of air permeable material may be provided under the vents. The air vents include upstanding air scoops which are formed integrally with the pad on at least some of its finger portions, and additional air scoops may be located over the back of the hand.

In the preferred embodiment, the air scoops include a generally forward facing and raised air inlet which vents to the underside of the pad. Some of the scoops are located behind the finger joints, while additional generally rearward facing air scoops are formed integrally with the pad and located forward of the finger joints. The raised air inlets of the scoops are canted back from perpendicular to the plane of the protective pad, so that bending the glove fingers about a motorcycle hand grip serves to both rotate the additional scoops forward of the finger joints toward a forward facing position, and to increase the effective air intake area of the scoops on both sides of the finger joints.

Additional air vents are provided in the form of a plurality of grills, each grill consisting of a number of parallel upstanding ribs formed integrally with the protective pad, with air vent openings formed in the pad between adjacent ribs. Both the upstanding portions of the air scoops and the grill ribs provide additional cushioning in case of a fall, and thereby enhance the protection provided by the glove. The protective pad is preferably formed from a unitary piece of flexible plastic material such as polyeurathane. Notches are formed in the periphery of the pad at locations corresponding to the finger joints, and the pad thickness is reduced in the vicinity of the knuckles to increase the overall flexibility of the glove.

These and other features and advantages of the invention will be apparent to those skilled in the art from the following detailed description of preferred embodiments, taken together with the accompanying drawings, in which:

DESCRIPTION OF THE DRAWINGS

FIG. 1 is a perspective view of a racing glove formed in accordance with the invention;

FIG. 4 is a cross-sectional view of the glove in a racing position taken along the line 4—4 of FIG. 1.

DETAILED DESCRIPTION OF A PREFERRED EMBODIMENT

Figure 2:
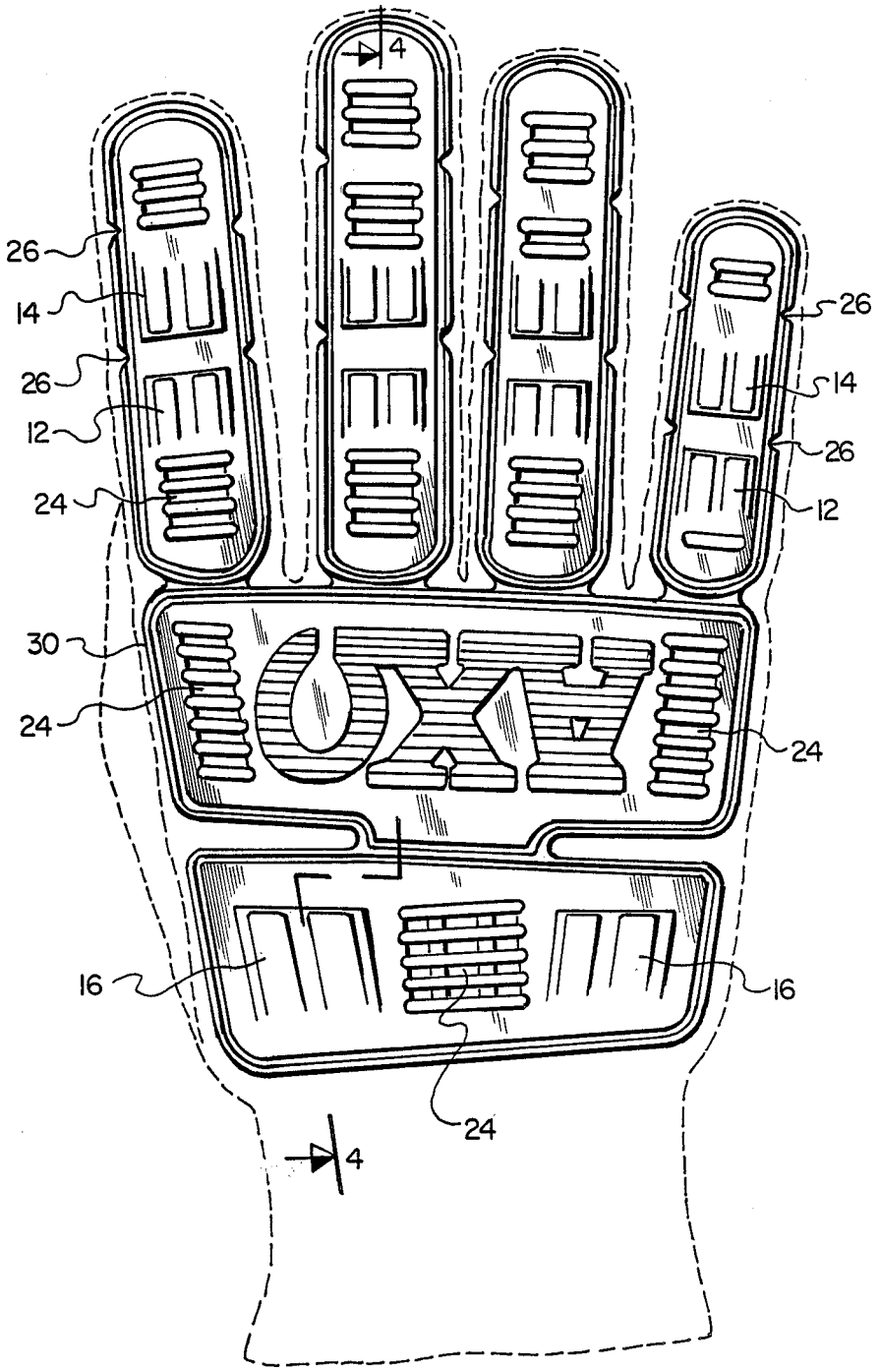
FIGS. 2 and 3 are respectfully top and bottom plan views of the protective pad attached to the top of the glove.

Referring first to FIG. 1, a perspective view of a racing glove formed in accordance with the invention is shown. The glove includes an inner glove portion 2 into which the wearer inserts his or her hand, and a protective pad 4 which is attached to and overlies the upper side of the inner glove. While protective pad 4 is shown as a single layer of material, it may also be formed from a number of separate pieces, such as individual pieces corresponding to each finger and one or two pieces for the back of the hand. While individual pieces tend to make the pad and glove somewhat more flexible, a single pad is easier to manufacture and may be provided with special features, described below, to make it more flexible. The pad is formed from a flexible plastic material, preferably injection molded polyeurathane with a thickness of about 1/16 inch. The pad is stitched about its periphery to the upper side of the glove.

The underside 6 or palm portion of the glove is preferable formed from a leather material such as cowhide or lambskin. A polyester stretch band 8 runs along the side of the glove, while a polyester stretch cuff 10 provides protection from dirt and mud. Ideally, the upper side of the glove immediately below the protective pad 4 is left open to provide maximum ventilation from the venting structures described below, or openings are formed in the glove immediately below each vent, with the pad sewn to the glove material around the periphery of the opening. However, leaving a large opening makes it difficult to properly align the pad on the glove and sew it in place. Accordingly, the upper side of the inner glove may be formed from an air permeable material, such as nylon mesh, which transmits cooling air coming in through the vents to the interior of the glove.

A number of air scoops are formed integrally with the protective pad material to bring outside cooling air into the glove interior. While numerous configurations and designs for the air scoops can be used, the preferred arrangement is best seen in the top and bottom plan views of the protective pad shown in FIGS. 2 and 3, respectively, and in FIG. 1. Forward facing air scoops 12 are located immediately behind the location of the middle joint for each of the fingers, while rearward facing air scoops 14 are located immediately forward of each of the finger joints. An additional and somewhat larger pair of forward facing air scoops 16 are positioned on opposite sides of the pad toward its rear, corresponding to a location over the back of the wearer's hand.

Each of the scoops is molded integrally with the polyeurathane protective pad. The forward end of each of the forward facing finger scoops 12 is raised and open so as to take in air when the wearer is in forward motion with a normal grip on the motorcycle hand grips. The rearward facing finger scoops 14 are identical in design to the forward facing scoops 12, but in effect are rotated 180° so that the rear portions of scoops 14 are raised and open. While at first impression this orientation for the forward air scoops 14 would appear to be the reverse of that necessary for them to take in air when the wearer is in forward motion, in actual practice the wearer's fingers and glove will be bent over the motorcycle hand grips, positioning the portion of the fingers forward of the middle joints generally on the underside of the grips. In this position, the raised open end of scoops 14 will actually be facing generally forward to receive air as the wearer moves forward.

Figure 3:
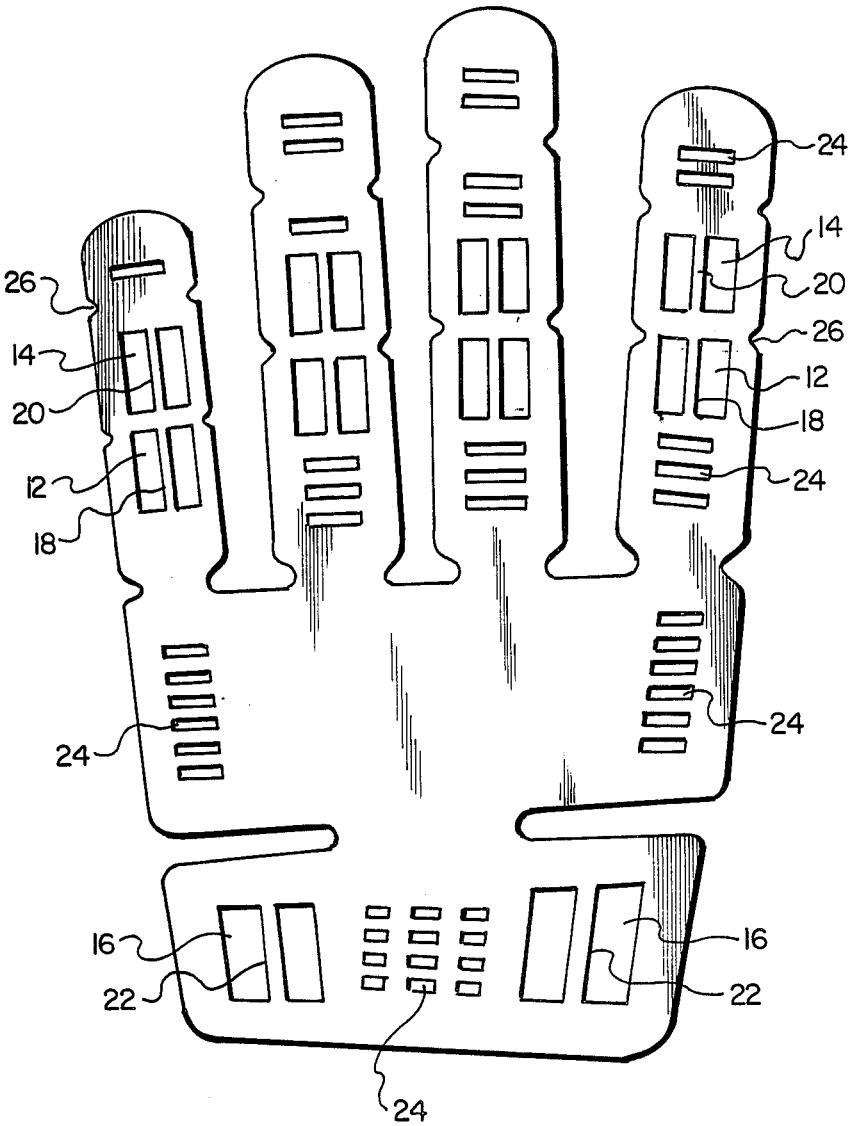

As shown in FIG. 3, the undersides of the various air scoops are open, permitting outside air which enters them to flow onto the wearer's hand, either directly if the glove is open beneath the pad, or through the air permeable material underlying the pad if such is used. Each of the scoops 12, 14 and 16 is provided with an integrally molded central strengthening rib 18,20,22, respectively, which provides vertical support for the upper wall of the scoop. In addition to helping hold the scoop open, the rib provides additional cushioning for the portion of the finger under the scoop in case the rider falls and strikes his hand on the ground.

In addition to the air scoops, a plurality of ventilating grills are provided in the protective pad at various additional locations where ventilation is desired. These grills, denoted by reference numeral 24, may be provided in various sizes and shapes, but have the same general type of construction. Each of the grills includes a plurality of generally parallel, upstanding ribs which are molded integrally with the protective pad and extend upwardly from the surface of the pad to provide additional protection and cushioning to the wearer in case of a fall. The pad is open between adjacent ribs to provide additional ventilation. The grill ribs are shown as being generally transverse to the direction of motion when the wearer is riding forward, but they could also be formed more parallel to the direction of motion. While a parallel orientation tends to increase the effective ventilation somewhat, the transverse orientation shown increases the protection afforded by the ribs.

One of the problems encountered with other protective devices is that they tend to restrict the movement and flexibility of the glove. This problem is greatly alleviated in the present invention by providing a protective pad which is formed from a flexible polyeurathane, and also by shaping the pad so that it had greatest flexibility at the locations which receive the greatest bending motions. Notches 26 are molded into the periphery of the pad on both sides of each finger portion at locations corresponding to the finger joints, to facilitate bending of the pad at these locations. In addition, the thickness of the pad is reduced in the vicinity of the knuckles 28, where the finger portions join the hand portions, to facilitate bending of the pad at these locations. The width of the finger portions where they join the hand portion is also reduced to increase flexibility.

A groove 30 is formed around the entire upper periphery of the pad as a guide for stitching the pad onto the underlying glove material. While the pad could also be glued or bonded onto the glove, stitching is preferred for neatness and durability.

Referring now to FIG. 4, a cross-sectional view of the glove and protective pad along one of the fingers and extending toward the rear of the glove is shown in the position that would normally be assumed when the wearer is gripping a motorcycle hand grip 31. The glove's upper layer is shown as a continuous material, although the upper portion of the glove below the pad may also be left open. The upper layer in this embodiment consists of an open weave nylon mesh 32 surmounted by a thin foam pad 33. As can be seen, the forwardmost grill 24 consists of a plurality of upstanding parallel ribs 34, between which openings 36 are provided in the pad material. Each of the other ventilation grills has a similar construction.

The forwardmost, rearward facing finger air scoop 14 is shown with an upper wall 38 that is progressively raised above the plane of the pad as the scoop progresses from the front toward the rear of the finger, and is open underneath. The inlet 40 to this air scoop is canted forward from perpendicular to the plane of the unflexed pad, which generally serves to increase the effective size of the opening when the glove is bent in a riding position. Proceeding back to the forward facing finger scoop 12, that scoop has an upper wall 42 which is progressively raised above the plane of the pad from the rear to the front of the scoop, and is open underneath. Its forward inlet 44 is canted rearward from perpendicular to the plane of the unflexed pad, which again serves to generally increase the effective inlet area in use. Proceeding further back on the finger, the thickness of the pad is reduced at the knuckle position 46 to make the pad and glove more flexible, as described above. Additional ventilation grills are provided on the finger and hand portion of the pad, while forward facing air scoop 16 at the back of the hand can be seen to be essentially similar to scoop 12 in construction, but larger.

In the gripping position of FIG. 4, the wearer's finger joint is located generally forward of the hand grip 31. In this position forward facing finger scoop 12 is generally above the axis of the grip, while rearward facing finger scoop 14 is generally bent below the grip axis. Thus, the inlets for both scoops will face generally forward to receive air which rushes in as the wearer moves forward. Since each of the scoop inlets is canted back from perpendicular to the plane of the unflexed pad, it can be seen that the inlets in use have a greater effective open area facing the oncoming air, and thus provide a greater amount of ventilation than would be the case if the inlets were perpendicular to the plane of the unflexed pad.

The glove thus described provides a high degree of wearer comfort because of its positive cooling action and flexibility, and at the same time affords good protection to the hand in case of a fall. While a particular embodiment of the invention has been shown and described, it should be understood that numerous variations and modifications will occur to those skilled in the art. Accordingly, it is intended that the invention be limited only in terms of the appended claims.

I claim:

1. A vented racing glove comprising:

an inner glove having hand and finger portions, an outer pad of flexible protective material attached to and overlying at least some of the fingers on the upper side of the glove, and a plurality of upstanding air scoops formed integrally with the pad on at least some of the finger portions of the pad, each of said air scoops including a raised air inlet which is oriented generally forward when the wearer grasps a motorcycle handlebar and directs a generally rearward flow of air into the underside of the pad in response to forward motion of the motorcycle.

2. The vented racing glove of claim 1, said air scoops being located behind the joints of their respective fingers.

3. A vented racing glove, comprising:

an inner glove having hand and finger portions, an outer pad of flexible protective material attached to and overlying at least some of the fingers on the upper side of the inner glove, and a plurality of upstanding air scoops formed integrally with the pad on at least some of the finger portions of the pad, said air scoops being located behind the joints of their respective fingers and including a generally forward facing and raised air inlet venting to the underside of the pad, the raised air inlets of said scoops being canted back from perpendicular to the plane of the unflexed protective pad, bending of the glove fingers serving to flex the air inlets forward so as to generally increase the effective air intake area when the wearer grips a motorcycle hand grip.

4. A vented racing glove, comprising:

an inner glove having hand and finger portions, an outer pad of flexible protective material attached to and overlying at least some of the fingers on the upper side of the inner glove, a plurality of upstanding air scoops formed integrally with the pad on at least some of the finger portions of the pad, said air scoops being located behind the joints of their respective fingers and including a generally forward facing and raised air inlet venting to the underside of the pad, and a plurality of additional generally rearward facing unstanding air scoops formed integrally with the protective pad and located forward of the finger joints, each of said additional air scoops including a generally rearward facing and raised inlet, bending of the glove fingers serving to flex the pad around the finger joints so as to rotate the additional scoops toward a generally forward facing position.

5. The vented racing glove of claim 4, the raised air inlets of said additional scoops being canted forward from perpendicular to the plane of the unflexed protective pad.

6. A vented racing glove, comprising:

an inner glove having hand and finger portions, an outer pad of flexible protective material attached to and overlying the back of the hand portion of the glove, and at least one upstanding air scoop formed integrally with the pad over the back of said hand portion, each of said air scoops including a raised air inlet which is oriented generally forward when the wearer grasps a motorcycle handlebar and directs a generally rearward flow of air to the underside of the pad in response to forward motion of the motorcycle.

7. A vented racing glove, comprising:

an inner glove having hand and finger portions, an outer pad of flexible protective material attached to and overlying the upper side of the inner glove, and a plurality of air vents formed in the protective pad for receiving air when the glove is in motion to cool the glove's interior, said air vents including a plurality of grills, each of said grills comprising a plurality of generally parallel upstanding ribs formed integrally with the protective pad and extending upwardly therefrom to provide additional cushioning in case of a fall, and vent openings formed in the pad between adjacent ribs.

8. The vented racing glove of claim 7, a plurality of said grills being formed on the finger portions of the protective pad.

9. The vented racing glove of claim 7, a plurality of said grills being formed on the back of the hand portion of the protective pad.

10. The vented racing glove of claim 1, the thickness of said protective pad being reduced in the vicinity of the knuckles to facilitate bending of the pad.

11. A vented racing glove, comprising a glove with finger and hand portions, and a plurality of upstanding air scoops formed on the upper portion of the glove, each of the air scoops including a raised air inlet which is oriented generally forward when the wearer grasps a motorcycle handlebar and directs a generally rearward flow of air to the interior of the glove in response to forward movement of the motorcycle.

12. The vented racing glove of claim 11, said glove being open under the air inlets and permitting outside air to flow in through the inlets and directly contact the wearer.

13. The vented racing glove of claim 11, including a layer of air permeable material under the scoops through which outside air can flow from the vent inlets to the wearer.

14. The vented racing glove of claim 11, said air scoops being located on at least some of the finger portions of the glove behind the finger joints.

15. A vented racing glove, comprising:

a glove with finger and hand portions, a plurality of upstanding air scoops formed on the upper portion of the glove on at least some of the glove's finger portions behind the finger joints, each of the air scoops including a generally forward facing and raised air inlet, and a plurality of additional generally rearward facing upstanding air scoops located forward of the finger joints and venting the glove, each of said additional air scoops including a generally rearward facing and raised air inlet, bending of the glove fingers serving to rotate the additional scoops to a generally forward facing position.

16. The vented racing glove of claim 11, at least some of said air scoops being formed over the back of the glove's hand portion.

17. A vented racing glove, comprising a glove with a plurality of vent grills formed therein, each of said grills comprising a plurality of generally parallel upstanding ribs formed from a protective material to cushion the wearer's hand in case of a fall, and vent openings formed between adjacent ribs.

18. The vented racing glove of claim 17, the glove being open below said grills so that outside air can flow through the grills directly to the wearer.

19. The vented racing glove claim 17, the glove including a layer of air permeable material under the grills through which outside air can flow to the wearer.

20. The vented racing glove of claim 1, said air scoops including lateral side walls, an upper wall, and at least one strengthening rib holding the upper wall outward from the glove between the side walls.

21. The vented racing glove of claim 11, said air scoops including lateral side walls, an upper wall, and at least one strengthening rib holding the upper wall outward from the glove between the side walls.

* * * * *